United States Patent [19]

Cates et al.

[11] Patent Number: 4,759,770

[45] Date of Patent: Jul. 26, 1988

[54] PROCESS FOR SIMULTANEOUSLY DYEING AND IMPROVING THE FLAME-RESISTANT PROPERTIES OF ARAMID FIBERS

[75] Inventors: Barbara J. Cates; James K. Davis; Tanya E. FitzGerald; Ernest J. Russell, all of Greensboro, N.C.

[73] Assignee: Burlington Industries, Inc., Greensboro, N.C.

[21] Appl. No.: 870,523

[22] Filed: Jun. 4, 1986

Related U.S. Application Data

[63] Continuation-in-part of Ser. No. 863,038, May 14, 1986, Pat. No. 4,710,200.

[51] Int. Cl.[4] ..... D06P 5/00

[52] U.S. Cl. ..... 8/490; 8/130.1; 8/586; 8/587; 8/925

[58] Field of Search ..... 8/490, 586, 587, 130.1

[56] References Cited

U.S. PATENT DOCUMENTS

| | | | |
|---|---|---|---|
| 2,235,603 | 12/1940 | Lubs | 8/402 |
| 2,290,945 | 7/1942 | Dahlen et al. | 8/564 |
| 2,989,360 | 6/1961 | Mautner | 8/553 |
| 3,558,267 | 1/1971 | Langenfeld | 8/586 |
| 3,741,719 | 6/1973 | Ramanathan et al. | 8/654 |
| 3,771,949 | 11/1973 | Hermes | 8/492 |
| 3,789,091 | 1/1974 | Anderson et al. | 524/119 |
| 3,837,802 | 9/1974 | Litzler et al. | 8/549 |
| 3,849,368 | 11/1974 | Anderson et al. | 524/119 |
| 3,884,626 | 5/1975 | Hoster et al. | 8/543 |
| 3,986,827 | 10/1976 | Dombchik | 8/527 |
| 4,059,403 | 11/1977 | Wolf et al. | 8/538 |
| 4,066,396 | 1/1978 | Wolf et al. | 8/489 |
| 4,525,168 | 6/1985 | Kelly | 8/130.1 |
| 4,705,523 | 11/1987 | Hussamy | 8/490 |
| 4,705,527 | 11/1987 | Hussamy | 8/558 |
| 4,710,200 | 12/1987 | Cates et al. | 8/574 |

FOREIGN PATENT DOCUMENTS 1282113 7/1972 United Kingdom .

OTHER PUBLICATIONS

"Dyeability of Nomex Aramid Yarn", by R. A. F. Moore et al., *Textile Research Journal,* pp. 254–260, 1985.

"Effect of Auxiliary Soilvents in STX Coloration of Aramids and PBI with Cationic Dyes", in *Book of Papers, ASTCC National Technical Conference,* Oct. 1983, pp. 314–326.

"Dyeing and Finishing Nomex Type 450 Aramid", *Bulletin NX-9,* Mar. 1978.

"Interactions of Nonaqueous Solvents With Textile Fibers, Part XI: Nomex Shrinkage Behavior", *Textile Res. J.,* 51, 323–331, (1981).

"Dyeability of Solvent Treated Fibers", *Book of Papers, AATCC National Technical Conference,* Moore et al., Oct. 1981, pp. 109–120.

"Interactions of Nonaqeuous Solvents With Textile Fibers, Part II: Isotherman Shrinkage Kinetics of a Polyester Yarn", *Textile Res. J.,* 43, 176–183, (1973), Ribnick et al.

"Interactions of Nonaqueous Solvents With Textile Fibers, Part III: The Dynamic Shrinkage of Polyester Yarns in Organic Solvents", *Textile Res. J.,* 43, 316–325, (1973), Ribnick et al.

"Interactions of Nonaqueous Solvents with Textile Fibers, Part VII: Dyeability of Polyester Yarns After Heat and Solvent-Induced Structural Modifications", *Textile Res. J.,* 46, 574–587, (1976), Weigmann et al.

"Evaluation of the STX System for Solvent Dyeing of Industrial Fabrics Part II: Kevlar Aramid and PBI Fabrics", Cook et al., *Journal of Industrial Fabrics,* vol. 2, No. 1, Summer 1983.

"Dyeability of Nomex Aramid Yarn", Moore et al., *Book of Papers,* 1982 *Technical Conference", pp. 94–99 (19).*

"High-Temperature Fibres and Their Identification", Prof. Maria Stratmann, *Melliand Textilberichte,* (English Edition), Mar. 1982, pp. 215–219.

"A Solvent-Dyeing Process for Aramid Fibers", J. Preston et al., *Textile Research Journal,* May 1979, vol. 49, No. 5, pp. 283–287.

*Primary Examiner*—A. Lionel Clingman

*Attorney, Agent, or Firm*—Nixon & Vanderhye

[57] ABSTRACT

Simultaneous dyeing and flame-resistant property improvement of poly(m-phenyleneisophthalamide) fibers using a swelling agent to introduce a dye and a fire retardant into the fiber. The dyed fiber has properties of strength approximating the original undyed fiber, fire retardance greater than the untreated fiber and is conveniently dyed to an unlimited range of colors with high color yield and relatively good lightfastness at a reasonable cost. An aqueous dimethylsulfoxide solution is used as the swelling agent.

18 Claims, 1 Drawing Sheet

PROCESS FOR SIMULTANEOUSLY DYEING AND IMPROVING THE FLAME-RESISTANT PROPERTIES OF ARAMID FIBERS

CROSS-REFERENCE TO RELATED APPLICATIONS

This application is a continuation-in-part of earlier application Ser. No. 863,038, filed May 14, 1986 now U.S. Pat. No. 4,710,700.

This invention relates to simultaneously dyeing and improving the flame-resistant properties of aramid fibers, especially poly(m-phenyleneisophthalamide) fibers, and more particularly to the continuous dyeing and improving the flame-resistant properties of aramid fibers in which the dye and fire retardant are introduced into the fiber while the fiber is in a solvent-swollen state.

BACKGROUND OF THE INVENTION

Aramid fibers are highly resistant to heat decomposition, have inherent flame retardant properties are frequently used in working wear for special environments where flame retardant properties are required. Fabrics made of these fibers are extremely strong and durable, and have been widely adopted for military applications where personnel have the potential to be exposed to fire and flame, such as aircraft pilots, tank crews and the like. There is a need for dyed fabrics that have flame-resistant properties even greater than the undyed fabrics or dyed fabrics. Meta-linked aromatic polyamide fibers (aramid fibers) are made from high molecular weight polymers that are highly crystalline and have either a high or no glass transition temperature.

These inherent desirable properties of aramid fibers also create difficulties for fiber processing in other areas; specifically, aramids are difficult to dye. Fiber suppliers currently recommend a complicated exhaust dyeing procedure with a high carrier (acetophenone) content; the process is conducted at high temperatures over long periods of time and often results in a product having an unpleasant odor. Such dyeing conditions require substantial amounts of energy both to maintain dyeing temperature and for the treatment of waste dye baths. Polar organic solvents have also been used to swell the fiber or create voids in the fiber structure to enhance dyeability. These procedures involve solvent exhaust treatments at elevated temperatures with subsequent dyeing.

Another source of dyed aramid fiber is solution dyed aramid yarn, available from the producer, prepared by solution dyeing in which a quantity of dye or pigment is mixed with the molten polymer prior to extrusion of the polymer into fine fibers; the dye or pigment becomes part of the fiber structure. Solution dyed fibers are more costly than the undyed fibers due, in part, to the additional costs of manufacture, and must be used in the color provided by the supplier, leaving the weaver with only a limited choice of colors. Solution dyed fibers offer relatively good lightfastness whereas some undyed aramid fibers, particularly Nomex, yellow following exposure to UV light. Because of this potential for yellowing, although deep, rich colorations, particularly dark blue and navy blue, are achievable they still lack acceptable lightfastness.

More recently, a process has been described in U.S. Pat. No. 4,525,168 in which acid or anionic dyes are introduced into aramid fibers by coupling the dye to a dye site receptor which, in turn, is attached to the fiber.

The process includes first swelling the fiber in a strong polar solvent and, while in the swollen condition, introducing a substance capable of forming a strong chemical bond with an anionic dye into the swollen fiber. This dye site receptor substance is an amine, typically hexamethylenediamine. The procedure described requires at least three steps, first pretreating the fiber in a solution of solvent/swelling agent, the diamine and a wetting agent, then drying to shrink the fiber and incorporate the diamine dye site receptor into the fiber. The thus pretreated fabric is then dyed with an anionic dye. Aramid fibers described and purported to be successfully dyed in U.S. Pat. No. 4,198,494 are sold under the trademarks Nomex and Kevlar by DuPont, and under the trademark Conex by Teijin Limited of Tokyo, Japan.

It is an object of the present invention to provide a continuous process for simultaneously dyeing and improving the flame-resistant properties of a dyeable, compatible aromatic polyamide fiber that will yield acceptable colorfastness without detracting from the inherent strength of the aramid fibers. Another object of this invention is to provide a continuous process adapted to simultaneously dye and fire retard large quantities of compatible aromatic polyamide fabric on a commercial scale at less cost than prior procedures.

BRIEF DESCRIPTION OF THE DRAWINGS

The process of the invention may take several forms, as illustrated in the attached drawings, in which.

SUMMARY OF THE INVENTION

Figure 1:
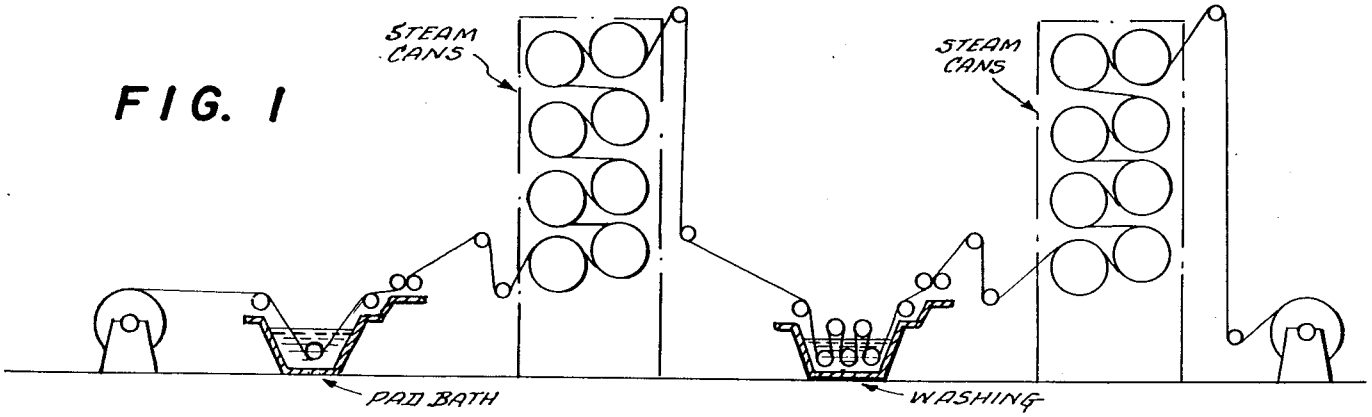
FIG. 1 is a schematic illustration of a process of applying the dye, fire retardant and swelling agent from a hot pad bath to a poly(m-phenyleneisophthalamide)-containing fabric, fixing the dye and drying the fabric over a stack of steam cans, washing to remove any residual swelling agent, drying the fabric on a second set of steam cans, and taking the dyed fabric up on a roll.

Disclosed is a process for the continuous or semi-continuous dyeing of and simultaneosuly improving the flame-resistant properties of poly(m-phenyleneisophthalamide) fibers that includes the step of introducing the fiber into a fiber swelling agent solution also containing at least one dye together with at least one fire retardant, thereby swelling the fiber and introducing both the dye and the fire retardant into the fiber while in the swollen state.

The fire retardant/performance properties of fabrics dyed by the process of this invention are significantly improved, far better than if after-treated with a fire-retardant finish applied from an aqueous solution following the dyeing and fixing operation. LOI values, as described in more detail below, may be as high as 44% for the simultaneously dyed and fire retarded T-455 Nomex fabric product produced by the process of this invention. As a means of comparison, undyed T-455 Nomex has an LOI of 26.6%.

Fiber swelling is accomplished in an aqueous solution of one or more fiber swelling agents. The following polar organic solvents have been found to be preferred swelling agents for poly(m-phenyleneisophthalamide) fiber:

N-methylpyrrolidone dimethylsulfoxide (DMSO)

dimethylacetamide (DMAc) Conveniently, these swelling agents are mixed with a compatible diluent, usually water, in various amounts; the swelling agent is present in a major amount, that is, more than half of the total weight of the solution. As an illustration, we have obtained good dye and FR fixation in a continuous pad-oven-dry process using dimethylsulfoxide (DMSO) and water in ratios of DMSO:water of 70:30 to 90:10 with best results at the 90:10 level.

Fibers suitable for the continuous dyeing and simultaneous fire-retarding process of this invention are known generally as aromatic polyamides. The class includes a wide variety of polymers as disclosed in U.S. Pat. No. 4,324,706, the disclosure of which is incorporated by reference. Our experience indicates that not all types of aromatic polyamide fibers can be reproducibly dyed by this process; those fibers that are not modified by the organic polar solvent/swelling agent and do not allow the dye to enter the fiber are only surface stained and are not fully dyed. Thus, the fibers amenable to the process of this invention are made from a polymer known chemically as poly(m-phenyleneisophthalamide), i.e., the meta isomer which is the polycondensation product of metaphenylenediamine and isophthalic acid. Below is a listing of fibers now commercially available. identified by fiber name (usually a trademark) and producer:

| Fiber Name | Producer |
|---|---|
| Nomex | DuPont |
| Apyeil (5207) | Unitika |
| Apyeil-A (6007) | Unitika |
| Conex | Teijin |

Selection of a suitable aromatic polyamide amenable to the continuous dyeing process of this invention can be conveniently made by subjecting a fiber sample to an abbreviated test to determine fiber dyeability. Our experience indicates that fibers of the para isomer, poly(p-phenyleneterephthalamide), represented commercially by DuPont's Kevlar and Enka-Glanzstoff's Arenka, as well as Rhone-Poulenc's Kermel and polybenzimidazole (PBI), are merely stained or changed in color but are not dyed by the process of this invention. Accordingly, as used in the text of this application and in the claims that follow, the expressions "aramid" and "aromatic polyamide fiber", when pertaining to the novel process of this invention will signify the meta isomer. Blends of poly(m-phenyleneisophthalamide) fibers with other fibers, including fibers of the para isomer, may be subjected to the dyeing process in which case only the meta isomer fibers will be dyed.

The polar organic solvent used in the continuous dyeing process of this invention has the ability to swell the aromatic polyamide fiber to be dyed with minimum or no damage to the fiber itself. Many polar organic solvents will successfully swell aromatic polyamide fibers to introduce a dye into the fiber but damage the fiber itself and are thus unsuited for use in undiluted form. Fiber damage can be mitigated or avoided by including an otherwise inert and compatible diluent such as water in the swelling agent system.

An important application of fabrics made of aramid fibers is the protection of military personnel to be fully acceptable for military applications, dyed aromatic polyamide fabrics must meet minimum strength requirements as defined in MIL-C-83420A for solution dyed fabrics. For convenience, comparison of the undyed (greige) T-455 fabric with the solution-dyed T-456 fabric and the dyed fabric resulting from the process herein described will be made. Highly polar organic solvents are notorious for degrading mechanical properties of aramid-type fibers, possibly by dissolving or solvating the polymer. To accommodate for this potential concern, the swelling agent system selected, when used at the appropriate temperatures and under the usual processing conditions, will result in a dyed aromatic polyamide fiber or fabric exhibiting at least 80%, preferably at least 90% if not identical to the strength of either the greige T-455 fiber or fabric as the case may be. Expressed conversely, the successfully dyed fiber or fabric exhibits no more than a 20% loss in strength, and preferably far less strength loss, and still will be acceptable for most applications.

The swelling agent system is composed of at least two components: (1) an organic polar solvent, and (2) a compatible, miscible "inert" diluent (inert in the sense that it does not itself enter into the dyeing process or interfere with the dyeing process) to minimize any damage that the polar organic solvent may cause to the fiber. It will be appreciated that the proportion of organic solvent to diluent, as well as the identity of each of the components, will vary depending upon several factors including the color to be achieved and the nature of the specific poly(m-phenyleneisophthalamide) fiber to be dyed, among others. Suitable swelling agents are selected from dimethylsulfoxide (DMSO), dimethylacetamide (DMAc), and N-methylpyrrolidone; DMSO is preferred. Suitable inert diluents include water, xylene (ortho, meta or para-dimethylbenzene), lower alkene glycols such as ethylene glycol and propylene glycol, alcohols such as n-propanol, methanol, benzyl alcohol, 4-butyrolactone, all of which are compatible with DMSO as the swelling agent, or other relatively high boiling organic liquids otherwise suited to the dyeing process. The selection of swelling agent and diluent is guided by optimum color yield balanced with minimum fiber damage.

While we do not wish to be bound to any particular theory or mode of operation, our experience leads us to believe that the swelling agent modifies the aromatic polyamide fiber by allowing both the dye and the fire retardant to enter the fiber. Examination by mass spectroscopy fails to reveal any swelling agent (DMSO) in a fiber dyed by the process of this invention. On the basis of washfastness and durability data for the dyed and fire retarded fabrics, we believe that the mechanism of dye attachment and fire retardant attachment to the fiber is a physical entrapment rather than a chemical covalent bonding. The absence of swelling agent in the fiber following treatment provides an odor-free product, allowing the swelling agent to be more efficiently recovered and permits practice of the invention without untoward environmental concerns.

The particular type of dyestuff used in the process is not critical and may be selected from acid, mordant, basis, direct, disperse and reactive, and probably pigment or vat dyes. Especially good results with high color yields are obtained with the following classes of dyes, particular examples given parenthetically: acid dyes (Acid Green 25), mordant dyes (Mordant Orange 6), basic dyes (Basic Blue 77), direct dyes (Direct Red 79), disperse dyes (Disperse Blue 56) and reactive dyes (Reactive Violet 1). Mixtures of two or more dyes from the same class or two or more dyes of different classes are contemplated. The dye selected will be compatible with and function effectively in the swelling agent system.

Also included in the dyebath are one or more fire-retardant agents in amounts sufficient to increase the already inherent flame-resistant properties of the fabrics. Conventional fire retardants may be used provided that they are compatible with other components of the system, notably the swelling agent, and impart the required degree of flame-resistant properties to the treated aramid fibers.

Fire retardant concentrations from 0.1% to about 20% are contemplated. However, the upper limit as a practical matter will be determined by the degree of performance required balanced against the cost of the FR chemical or system used. Concentrations in the range of about 1% to about 15% have been shown to be effective in increasing LOI values from 0.280 for greige Nomex T-455 to 0.440 for Nomex T-455 that has been simultaneously dyed and FR treated in accordance with the present invention. Amounts as little as 1% added FR chemical result in an LOI value of 0.30+ for the dyed and FR treated fabric made in accordance with the present invention.

Fixation of the fire retardant and the dye is by heating such as using a tenter frame, drying on steam cans or the like.

Preferred fire-retardant materials used in accordance with the present invention are thermally stable cyclic phosphonate esters prepared by reacting alkyl-halogen-free esters with a bicyclic phosphite. As a class these cyclic phosphonate esters are represented by one of the formulas:

(A)

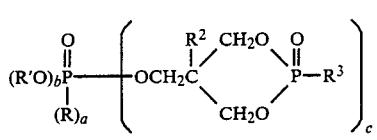

where a is 0 or 1; b is 0, 1 or 2, c is 1, 2 or 3 and a+b+c is 3; R and R′ are the same or different and are alkyl ($C_1$–$C_8$), phenyl, halophenyl, hydroxyphenyl, tolyl, xylyl, benzyl, phenethyl, hydroxyethyl, phenoxyethyl, or dibromophenoxymethyl; $R^2$ is alkyl ($C_1$–$C_4$); and $R^3$ is lower alkyl ($C_1$–$C_4$) or hydroxyalkyl ($C_1$–$C_4$) or (B)

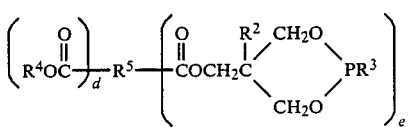

where d is 0, 1 or 2; e is 1, 2 or 3; $R^2$ is alkyl ($C_1$–$C_4$); $R^3$ is lower alkyl ($C_1$–$C_4$) or hydroxyalkyl ($C_1$–$C_4$); $R^4$ is alkyl ($C_1$–$C_4$) phenyl, halophenyl, hydroxyphenyl, hydroxyethyl phenoxyethyl, dibromophenoxyethyl, tolyl, xylyl, benzyl, or phenethyl; and $R^5$ is monovalent alkyl ($C_1$–$C_6$); chlorophenyl, bromophenyl, dibromophenyl, tribromophenyl, hydroxyphenyl, naphthyl, tolyl, xylyl, benzyl, or phenethyl; divalent alkylene ($C_1$–$C_6$), vinylene, o-phenylene, m-phenylene, p-phenylene, tetrachlorophenylene (o, m, or p), or tetrabromophenylene (o, m, or p); or trivalent phenyl.

The preferred compounds are represented by the formula:

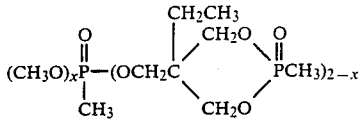

in which x is 0 or 1, and usually a 50:50 mixture of the mono- and di-esters. The preparation of these cyclic phosphonate esters and their use as flame retardants are described in U.S. Pat. Nos. 3,789,091 and 3,849,368, the disclosures of which are hereby incorporated by reference.

In addition to the swelling agent, the inert diluent(s), fire retardant(s) and the dye, the customary dye pad bath additives and auxiliaries may be included, such as softeners (to improve hand), UV absorbing agents, IR absorbing agents, antistatic agents, water repellants, anti-foaming agents, and the like. Alternatively, these and other treatments may be applied to the fabric as a post-treatment finish after dyeing, heating, washing and drying are completed. Preferably the dyed fabric is water washed to remove any residual swelling agent remaining on the fabric. Typically, the wash water remains clear (uncolored) indicating good dye fixation. Details as to dye fixation, retention, washfastness and like data are given in earlier application Ser. No. 863,038, the disclosure which is incorporated by reference.

Greige fibers that are dyed by the process of this invention (as distinguished from solution-dyed fibers in which a coloring agent is included in the molten resin prior to fiber formation) are virtually free of acetophenone, chlorinated solvents such as perchloroethylene, and other toxic solvent residues. As an example, residual DMSO amounts in fibers dyed by the process of this invention have been measured at less than 0.012 ppm. The dyed fibers have a strength retention of at least 80% of the undyed fibers. These properties distinguish products produced by our process from aramids dyed by the conventional process, using acetophenone as a dye carrier, which retain that solvent tenaciously, and Nomex dyed by the STX process in which the fibers retain small amounts of perchloroethylene.

Figure 2:
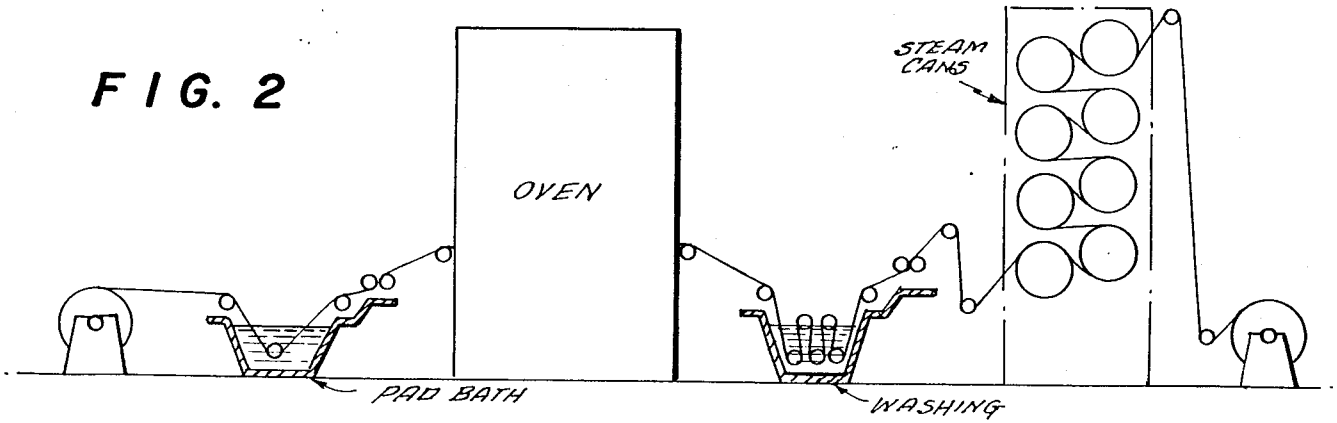
FIG. 2 is a schematic illustration of applying the dye, fire retardant and swelling agent from a pad bath onto the fabric, drying and fixing the fabric in a tenter oven, followed by washing and drying on a stack of steam cans.

The physical form of the fiber to be dyed is also open to wide variation at the convenience of the user. Most dyeing operations and equipment are suited to treatment of woven or knit fabrics in the open width as illustrated in FIGS. 1 and 2. It is also possible to slasher dye the fibers in yarn form and thereafter weave or knit the yarns into the item desired.

Testing procedures that were used in the examples are described in detail as follows:

FR Federal Test Method 5903 is intended for use in determining the resistance of cloth to flame and glow propagation and tendency to char. A rectangular cloth test specimen (70 mm×120 mm) with the long dimension parallel to the warp or fill direction is placed in a holder and suspended vertically in a cabinet with the lower end $\frac{3}{4}$ inch above the top of a Fisher gas burner. A synthetic gas mixture consisting primarily of hydrogen and methane is supplied to the burner. After the specimen is mounted in the cabinet and the door closed, the burner flame is applied vertically at the middle of the lower edge of the specimen for 12 seconds. The specimen continues to flame after the burner is extinguished. The time in seconds the specimen continues to glow after the specimen has ceased to flame is reported as afterglow time; if the specimen glows for more than 30 seconds, it is removed from the test cabinet, taking care not to fan the glow, and suspended in a draft-free area in the same vertical position as in the test cabinet. Char length, the distance (in mm) from the end of the specimen, which was exposed to the flame, to the end of a lengthwise tear through the center of the charred area to the highest peak in the charred area, is also measured. Five specimens from each sample are usually measured and the results averaged.

FR Federal Test Method 5905, flame contact test—a measurement of the resistance of textiles and other materials to flame propagation that exposes the specimen to the flame source for a longer period of time than test method 5903. A text specimen the same size as in the above method is exposed to a high temperature butane gas flame 3 inches in height by vertical suspension in the flame for 12 seconds, the lowest part of the specimen always 1.5 inches above the center of the burner. At the end of 12 seconds, the specimen is withdrawn from the flame slowly, and afterflaming is timed. Then the specimen is re-introduced into the flame and again slowly withdrawn after 12 seconds and any afterflame times. For each 12-second exposure the results are reported as: ignites, propagates flame; ignites but is self-extinguishing; is ignition resistant; melts; shrinks away from the flame; or drops flaming pieces.

In the examples that follow, all parts and percentages are by weight.

Limiting Oxygen Index (LOI) is a method of measuring the minimum oxygen concentration needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted), and the test is repeated until the lowest concentration of oxygen needed to support burning is reached.

EXAMPLE I

Continuous dyeing of Type 455 woven Nomex in open width was accomplished as follows: three pad baths were prepared each containing 90 parts by weight DMSO and 10 parts by weight water to which was added a mixture of 1.20% Irgalan Olive 3 BL 133 (Acid Green 70), 0.09% Intralan Orange P2R, and 0.09% Nylanthrene Yellow SL 200 (Acid Yellow 198) to make sage green. The first pad bath contained no fire retardant, the second 2.5% of Antiblaze 19 and the third bath contained 15.0% Antiblaze 19. The dyebath was padded onto T-455 Nomex at 200° F. from a heated bath at a speed of 20 yards per inute and a pad pressure of 20 psi resulting in a wet pick-up of approximately 90%. The padded fabric was then dried on steam cans maintained at 250° F. for about 24 seconds resulting in a fabric temperature of about 180°-215° F. The fabric was then washed and dried in an oven.

Samples of the fabric so treated were then subjected to testing for flame-resistant properties including Limiting Oxygen Index (LOI) and Federal Test Methods (FTM) 5903 and 5905. LOI values are reported for the treated fabric, after scouring and after 25 launderings; W is warp, F is fill. Results of the tests are given in the following table:

| | | | Sage Green 0% AB-19 | Sage Green 2.5% AB-19 | Sage Green 15.0% AB-19 |
|---|---|---|---|---|---|
| LOI's (%) | orig. | | 27.1 | 33.1 | 41.5 |
| | scour | | 26.9 | 33.5 | 41.3 |
| | 25 La | | 27.8 | 34.9 | 44.3 |
| FTM | after- | W | 0 | 0 | 0 |
| 5903 | flame | F | 0 | 0 | 0 |
| after 25 La | after- | W | 11.8 | 0 | 0 |
| @ 140° F. | glow | F | 9.6 | 0 | 0 |
| | char | W | 1.6 | 1.2 | 0.9 |
| | | F | 1.4 | 1.1 | 0.9 |
| FTM 5905 | after | W | 9.0 | 2.0 | 0 |
| (modified) | flame 1 | F | 8.5 | 1.0 | 0 |
| after 25 La | after | W | 2.5 | 0 | 0 |
| @ 140° F. | flame 2 | F | 0 | 0 | 0 |
| | after | W | 14.0 | 0 | 0 |
| | glow | F | 16.0 | 0 | 0 |
| | char | W | 2.6 | 1.5 | 1.9 |
| | | F | 3.0 | 1.9 | 1.6 |
| | % con- | W | 21.7 | 12.5 | 15.8 |
| | sumed | F | 25.0 | 15.8 | 13.3 |

Other embodiments of the invention in addition to those specifically described and exemplified above will be apparent to one skilled in the art from a consideration of the specification or the practice of the invention disclosed herein. It is intended that the specification and examples be considered as exemplary only, with the true scope and spirit of the invention being indicated by the claims that follow.

What is claimed:

1. A process for the simultaneous dyeing and flame retarding a poly(m-phenyleneisophthalamide) fiber, comprising the steps of:

(1) contacting a dyeable poly(m-phenyleneisophthalamide) fiber with a solution of an organic swelling agent adapted to swell said fiber and selected from the group consisting of N-methylpyrrolidone, dimethylsulfoxide, and dimethylacetamide, and a diluent, in which the weight ratio of swelling agent to diluent is from about 70:30 to 90:10, a solvent-compatible dyestuff dissolved in said solution and a flame retardant, the solution maintained at a temperature in the range of about 65° F. to about 200° F.;

(2) heating the poly(m-phenyleneisophthalamide) fiber treated in step (1) to fix said dye and said flame retardant to said fiber;

(3) washing the fiber to remove any residual dye, organic swelling agent or flame retardant; and (4) drying the fiber.

2. The process of claim 1, in which the solution contains a mixture of dimethylsulfoxide and water.

3. The process of claim 2, in which said solution contains a mixture of dimethylsulfoxide and water in a weight ratio of about 90:10.

4. A process of simultaneously dyeing and flame retarding a poly(m-phenyleneisophthalamide) fiber comprising the sequential steps of:

(a) contacting a dyeable poly(m-phenyleneisophthalamide) fiber with a dyebath solution containing (1) an organic polar solvent swelling agent selected from the group consisting of dimethylsulfoxide, N-methylpyrrolidone and dimethylacetamide, (2) a compatible inert diluent to dilute the swelling agent and protect the fiber from degradation in which the weight ratio of swelling agent to diluent is from about 70:30 to 90:10, (3) a dye dissolved in the solution, and (4) a flame retardant to improve the flame-resistant properties of the fiber, provided that the swelling agent is adapted to swell the fiber and allow the dye and the flame retardant to enter into and become fixed in the fiber, and the swelling agent and inert diluent are present in proportions such that the mechanical strength of the dyed fiber is at least 80% of the strength of the untreated fiber, (b) heating the fiber to fix the dye and the flame retardant in the fiber;

(c) washing the fiber to remove residual dye, organic swelling agent or flame retardant; and (d) drying the fiber.

5. The process of claim 4 in which the diluent (2) is selected from the group consisting of water, xylene, ethylene glycol, lower alkanols and 4-butyrolactone.

6. The process of claim 4 in which the dye (3) is selected from the group consisting of acid dyes, mordant dyes, basic dyes, direct dyes, disperse dyes and reactive dyes.

7. The process of claim 4 in which step (a) is conducted at a temperature in the range of room temperature to about 200° F.

8. The process of claim 4 in which the strength of the dyed fiber is at least 90% of the strength of an untreated fiber.

9. The process of claim 7 in which the swelling agent (1) is dimethylsulfoxide and the diluent (2) is water.

10. Fibers of poly(m-phenyleneisophthalamide) dyed and flame-retardant treated by the process of claim 4.

11. A process for the continuous dyeing and simultaneous flame retarding of poly(m-phenyleneisophthalamide) fiber comprising the steps of:

(i) contacting solvent-swellable, dyeable poly(m-phenyleneisophthalamide) fibers with a liquid swelling agent system containing a dye and a flame retardant dissolved in an organic swelling agent selected from the group consisting of dimethylsulfoxide, N-methylpyrrolidone, and dimethylacetamide and an inert diluent in which the weight ratio of swelling agent to diluent is from about 70:30 to 90:10, and allowing the thus contacted fiber to swell and admit the dye and the flame retardant into the swollen fiber;

(ii) heating the fiber to fix the dye and the flame retardant in the fiber;

(iii) washing the fiber to leave substantially no liquid swelling agent in the fiber.

12. The process of claim 11 in which the dyed fiber has at least 80% of the strength of the undyed, untreated poly(m-phenyleneisophthalamide) fiber.

13. The process of claim 12 in which the dyed fiber has at least 90% of the strength of the undyed, untreated poly(m-phenyleneisophthalamide) fiber.

14. The process of claim 11 in which the dyeing in step (i) is conducted at a temperature in the range of from room temperature up to about 200° F.

15. A process for the continuous dyeing and simultaneous flame retarding of a fabric comprising poly(m-phenyleneisophthalamide) fibers to a level shade, said process comprising the steps of:

(1) applying a dye solution of at least 70 parts by weight of an organic swelling agent selected from the group consisting of N-methylpyrrolidone, dimethylsulfoxide and dimethylacetamide, an inert diluent, a tinctorial amount of a dyestuff and a flame retardant, to a woven or knit fabric containing poly(m-phenyleneisophthalamide) fibers, the dye solution applied at a temperature in the range of from room temperature up to about 200° F.;

(2) heating the fabric to fix the dye and the flame retardant in the poly(m-phenyleneisophthalamide) fibers;

(3) washing the heated fabric to remove any residual dye, organic swelling agent or flame retardant from the fabric; and (4) drying the thus treated fabric.

16. A woven or knit fabric having a Limiting Oxygen Index (ASTM D-2863-77) of greater than 27% in which the poly(m-phenyleneisophthalamide) fibers are dyed by the process of claim 15.

17. A dyed, flame-resistant knit or woven fabric consisting essentially of poly(m-phenyleneisophthalamide) fibers containing within the fiber an amount of cyclic phosphonate flame retardant sufficient to impart a Limiting Oxygen Index (ASTM D-28633-77) greater than 0.27.

18. The fabric of claim 17 having a Limiting Oxygen Index in the range of 28% to about 45%.

* * * * *